United States Patent [19]

Stone

[11] Patent Number: 4,521,302

[45] Date of Patent: Jun. 4, 1985

[54] END ELEVATION ADJUSTMENT OF MATERIAL SEPARATING TABLES

[76] Inventor: Spencer A. Stone, 1405 Three Rivers, E., Fort Wayne, Ind. 46802

[21] Appl. No.: 597,178

[22] Filed: Apr. 5, 1984

[51] Int. Cl.[3] ..... B03B 5/04

[52] U.S. Cl. ..... 209/441; 209/437; 209/508

[58] Field of Search ..... 209/441, 437, 508, 503, 209/442, 443, 504, 415, 416.1; 414/909; 211/209

[56] References Cited

U.S. PATENT DOCUMENTS

| | | | |
|---|---|---|---|
| 2,429,543 | 10/1947 | Bastanchury | 209/508 |
| 2,627,984 | 2/1953 | Senn et al. | 212/148 |
| 3,113,681 | 12/1963 | Crile | 212/228 |
| 3,241,674 | 3/1966 | Weber | 209/444 |
| 3,291,306 | 12/1966 | Stone | 209/441 |

*Primary Examiner*—Tim Miles
*Assistant Examiner*—Thomas M. Lithgow
*Attorney, Agent, or Firm*—George A. Gust

[57] ABSTRACT

A material separating system is disclosed having one or more pendantly supported tables with head motion devices for imparting reciprocatory motion to each of those tables to separate material mixtures supplied to the tables into at least two fractions in accordance with the specific gravity of the materials so that one fraction includes particles essentially all of which have specific gravities above some predetermined value while the other fraction particles are substantially all below that predetermined specific gravity value. Associated with each vibrator and the table or tables reciprocated by that vibrator is a remotely actuable device for modifying the attitude of the table or tables and therefor also the predetermined specific gravity value. This actuator is effective to change the pendant support of the table or tables under the control of a controller unit which may simultaneously actuate a plurality of the remotely actuable devices so as to change in unison the specific gravity values for each of the tables to which it is connected.

8 Claims, 3 Drawing Figures

END ELEVATION ADJUSTMENT OF MATERIAL SEPARATING TABLES

SUMMARY OF THE INVENTION

The present invention relates generally to vibrating type separating devices or concentrators as used in refining coal, ores and the like and more especially to improvements in schemes for pendantly supporting such separating devices in a manner to facilitate adjustment in the separator attitude and therefore also to vary the constituent make-up of the fractions of materials separated thereby. In particular the present invention provides an end elevation control for separators actuable from a remote location thereby allowing a plurality of such separators to be end elevation adjusted in unison.

Vibratory type separating devices are well known and well established in the art and are highly successful in separating materials in accordance with the specific gravity of the respective materials. Illustrative of such devices is U.S. Pat. No. 3,075,644. One such device manufactured by applicant's assignee employs a generally parallelogram shaped separating table having a plurality of alternate ridges and grooves frequently referred to as riffles extending generally parallel to the shorter of the two diagonals of the parallelogram shaped table. Near one end of this shorter diagonal a so called head motion device or drive unit, which is an eccentrically actuated vibrator imparting a differential reciprocatory motion to the table, is fastened to the table by a ball and socket joint or other suitable coupling. Such head motion devices are disclosed, for example, in U.S. Pat. Nos. 3,119,275; 3,291,306; and 4,080,840.

One economical scheme for mounting such material separating tables which provides good isolation of the table vibratory motion from the surrounding building or other environment is to pendantly support the table and drive unit from a plurality of cables or wire ropes so that minimal vibratory motion is transmitted from the separating device to the environment. Such pendant support schemes also minimize the noise associated with vibratory separators. Typical of such pendant support schemes is a plurality such as four fixed length wire ropes supporting the head motion device and by way of the swivel connections between that device and the table decks also supporting one table corner adjacent to the head motion. Individual cables are affixed to the remaining three table corners to complete the pendant support scheme. With this arrangement the primary weight of the separating system is borne by the four wire ropes supporting the head motion device and the fifth wire rope connected to the table diagonally opposed to that head motion device while the remaining two wire ropes which are generally diagonally opposite one another along the longer diagonal of the deck or decks provides lateral stability to the table and are designed to allow the incorporation of a scheme for manually varying the side tilt of the table decks.

One known side tilt adjustment technique employs a turn buckle or manually adjustable hand wheel for shortening or lengthening the effective length of the wire rope supporting one of the two diagonally farther opposed table corners while the other corner is suspended by a relatively constant tension arrangement such as a pulley supported counter balance weight arrangement. In such a scheme side tilt is varied by twisting the turn buckle to lengthen or shorten the wire rope while the constant tension wire rope automatically compensates for such variations.

End elevation adjustments have also been manually accomplished in systems as thus far discussed by providing the wire rope which supports the table corner diagonally opposite the head motion device with a turn buckle the manual twisting of which effectively lengthens or shortens that wire rope. With such end elevation adjustments, the table corner supported by the constant tension wire rope essentially follows or moves in the same direction as the corner being raised or lowered thus inducing some side tilt change with the end elevation adjustment.

These known schemes as thus far discussed provide very effective material separation in accordance with specific gravity wherein heavier material migrates along the riffles toward the table end opposite the drive unit falling off that end into a material collecting trough while lighter weight material in the company of a laterally moving water flow is conveyed to and off one side of the table again into a collecting trough for subsequent material processing or use.

A difficulty arises when it is desired to change a separating table deck and more often group or bank of such tables so that the specific gravity at which the table is dividing materials into two fractions is modified. Such change over might, for example, occur when processing coal from different veins or sources having differing ash content and therefore differing specific gravity at which it is desired to segregate or purify the coal. With the thus far discussed system, the entire system must be shut down for a rather considerable length of time while adjustments are made to the attitudes of each of the tables in a very slow manual manner representing substantial lost processing time and associated irretrievable overhead expense. Adjustments in altitude or endwise inclination of individual table decks frequently result in a lack of uniformity of material separation among the individual tables in a bank of separators.

Among the several objects of the present invention may be noted a reduction in down time during separator end elevation adjustment and an improvement in uniformity among separator tables within a bank of such tables; the provision of an end elevation control assembly for a pendantly supported material separating device which may be remotely controlled; the provision of a readily variable coal washing system; a provision of a control arrangement for a bank of separating tables; and the provision of a system for adjusting a plurality of coal washing tables simultaneously from a common remote location. These as well as other objects and advantageous features of the present invention will be in part apparent and in part pointed out hereinafter.

In general a material separating system has a plurality of pendantly supported tables including head motion devices for imparting a reciprocatory motion to each table deck to separate material mixtures supplied to the decks into fractions, a first fraction having a specific gravity above a predetermined value and a second fraction having specific gravity below that predetermined value and includes a plurality of remotely actuable devices for modifying the attitude of respective tables and thus also the predetermined specific gravity by changing the pendant support of those tables along with a common control unit for simultaneously actuating the plurality of attitude modifying devices so that the specific gravity which represents the dividing line between the two fractions is changed in unison for all of the tables.

Also in general and in one form of the invention, a concentrator of the type having a separating table and a drive unit coupled to that table and suspended by a plurality of wire ropes has one of the wire ropes adapted to be selectively raised and lowered under the control of an operator located remote from the concentrator.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
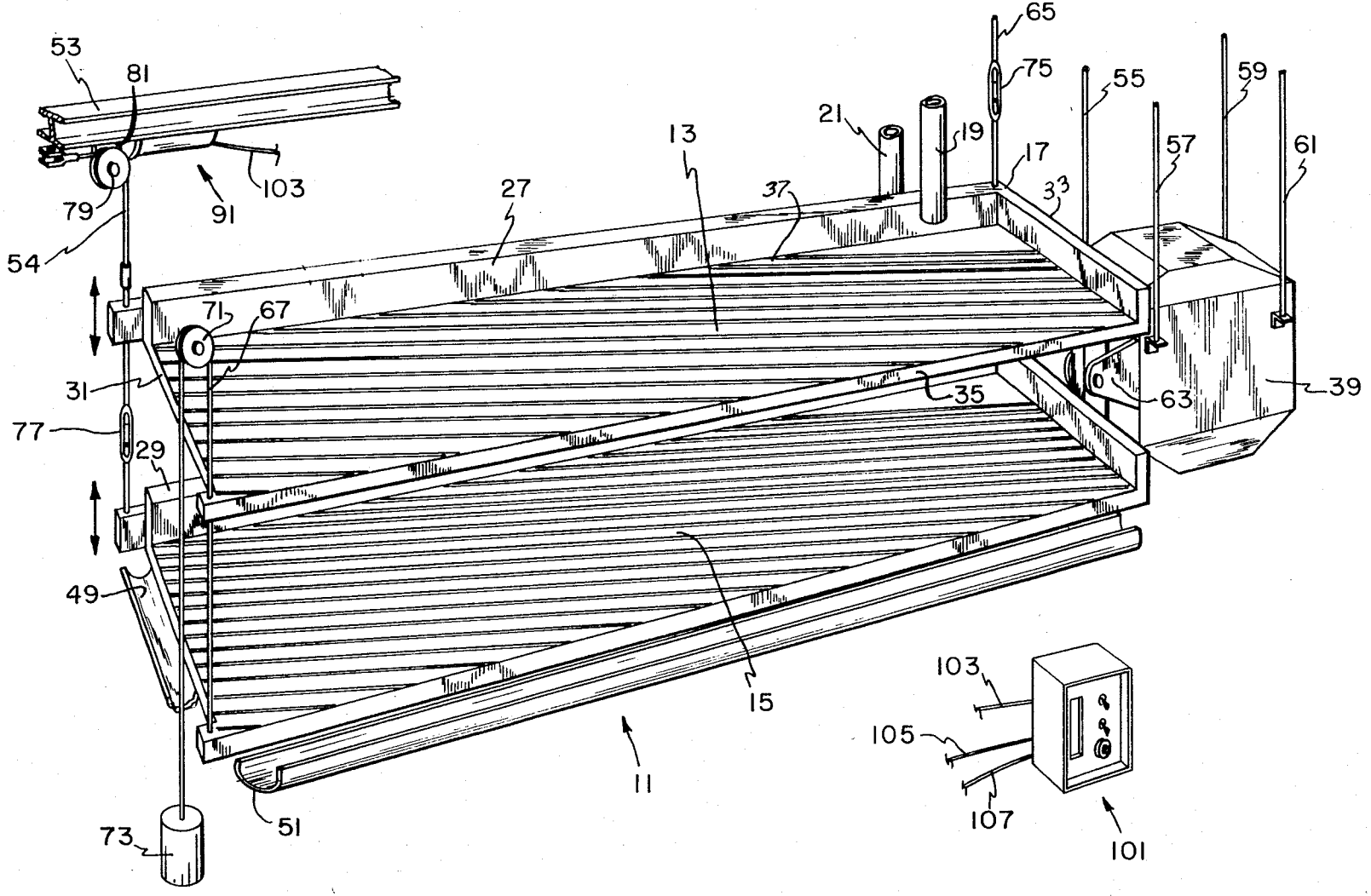
FIG. 1 is a perspective view of a pendantly supported separating device employing the attitude adjusting techniques of the present invention.
Figure 3:
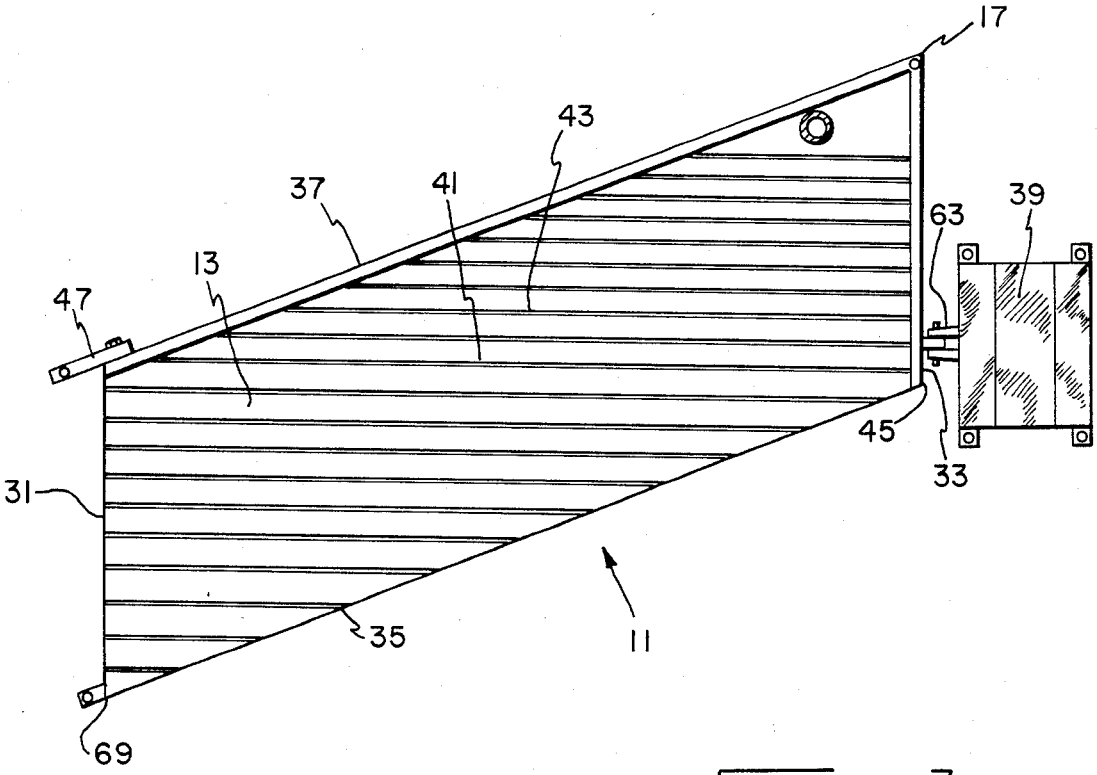
FIG. 3 is a plan view of the separating device of FIG. 1.

Referring first primarily to FIGS. 1 and 3 there is illustrated a pendantly supported material separating device 11 of the type having a polygonal deck 13 in this case shaped as a parallelogram and suspended over a second deck 15 of like configuration. A mixture such as impurity-containing coal is supplied to the table near corner 17 by so called downcomer or feedpipe 19 for the upper deck 13 and 21 for the lower deck 15. Material supplied by way of these feedpipes is a mixture of particles of differing specific gravities which are to be separated in accordance with those specific gravities. Water may be introduced onto the surface of the deck by means of water distribution troughs 27 as shown in U.S. Pat. No. 3,241,674. Further details and the theory of operation of such material separating devices may be found in the above mentioned prior patents. The essence of the operation of such separators is that the end 31 of the deck such as 13 is elevated slightly above the opposing end 33 while side edge 35 is somewhat below the opposing side 37 so that when the head motion device 39 imparts a differential reciprocatory motion to the deck 13 which is generally along the lines of the riffles such as 41 and 43 which in turn is generally along the line of the shorter diagonal of the table extending between corners 45 and 47 heavier material such as rock stays within the troughs defined by the riffles 41 and 43 moving uphill and off edge 31 into a trough or refuse launder 49 while the lighter material such as enriched coal moves crosswise to the riffles along with the flow of water off edge 35 into the launder or trough 51. Uphill movement of the heavier material along the riffles occurs because the head motion device 39 imparts a differential motion to the deck in the sense that the deck 13 is jerked toward the right as viewed in FIG. 3 rather abruptly while its leftward movement is more gradual causing that material to move toward the left with the deck while the deck is, so to speak, jerked from beneath the material not retracing its motion toward the right. The respective fractions accumulated in troughs 49 and 51 conveyed therefrom for subsequent use in any conventional manner.

Head motion device 39 rather abruptly shakes the deck 13 or table 13 and 15 depending upon the particular installation and a great deal of vibration and noise is associated with such violent table shaking. Pendant support of the table significantly reduces the transmission of such vibration to floors and other surrounding structures. Such pendant support is achieved by suspending the separating device from existing ceiling beams within a building or from overhead beams such as 53 specially provided for this purpose. Primary weight of the separating device is, as illustrated in FIG. 1, borne by cable or wire rope 54 at one table end while the other table end is supported from four cables, 55, 57, 59 and 61 by way of the coupling 63 between head motion device 39. Side tilt support of the table is then by way of cables 65 and 67 at opposite table corners along the longer diagonal of the parallelogram shaped deck. The cables or wire ropes 55, 57, 59 and 61 are adjusted as to maintain the vibrator in a level attitude and thereafter are not changed, however, table attitude may from time to time be changed so as to change the specific gravity dividing line between the two fractions of materials which are being segregated by the separating device. Coupling 63 may, for example, be a ball and socket joint or other universal type joint allowing the vibrator to remain in a fixed attitude while allowing some freedom of adjustment of the separating table.

Table attitude adjustment is facilitated by suspending the table corner 69 with a lifting force which is substantially independant of the elevation of that corner. This is achieved by passing cable 67 over a pulley 71 with the end of cable 67 opposite its point of attachment to corner 69 supporting a counter balance weight 73. Pulley 71 is of course fixed to a superstructure support arrangement, for example, like the beam 53. Provision of a turnbuckle 75 or other adjusting arrangement in or above cable 65 then allows the side tilt of the table to be controlled, for example, simply by tightening or loosening the turn buckle 75. Similar turnbuckles such as 77 may be provided in the suspension system wherever it may be desired to adjust or finetune either the attitude of a given deck or the attitude of one deck relative to the other deck. Such manual adjustment features, such as turn buckles 75 and 77, are quite suitable for initial installation and adjustment preparatory to running materials to be separated, however, adjustments that are required daily or more often as, for example, when different batches of coal or ore are to be separated by the table cannot conveniently be such manual arrangements since the time required for changing table attitude manually becomes excessive. The arrangement for supporting table corner 47 significantly reduces the manual adjustment time and further allows a plurality of such separators to be simultaneously adjusted to accommodate, for example, coal or other material from a different vein or batch to be separated.

Figure 2:
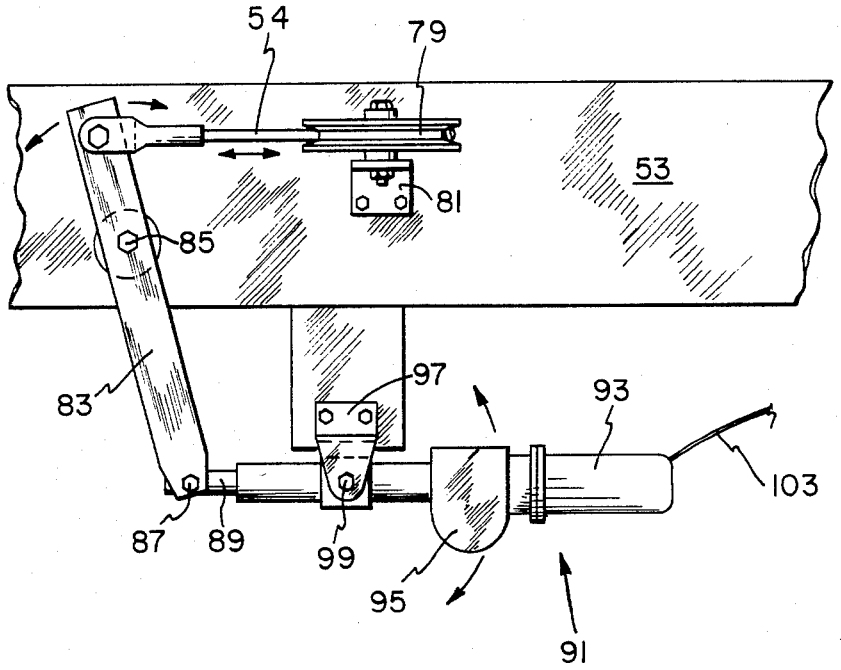
FIG. 2 is a bottom view of the remotely controllable table corner suspension arrangement of FIG. 1.

The system for supporting table corner 47 at any selectable elevation within some prescribed range is illustrated primarily in FIGS. 1 and 2 and includes pulley 79 having a fixed axial position and including a bracket 81 fastening that pulley to the beam 53. Wire rope 54 has one end connected to the deck corner 47 and the other connected to one end of a lever 83 having a fixed fulcrum 85 and a pivotal connection 87 at the opposite lever end interconnecting that lever with piston rod 89 of an electrically operated actuator 91. Actuator 91 is a commericially available electromechanical device having an electric motor 93 and a speed reduction gear box 95 so that acutation of the motor causes the extension or retraction of the piston rod 89. The acutator 91 is pivotably attached by a bracket 97 to the beam 53 and pivots about a pin having an axis 99 as the piston rod 89 extends and retracts with that extension and retraction in turn pivoting lever 83 about its axis or fulcrum 85 to raise or lower cable 54. A suitable electromechanical acutator is commericially available from Andco Acuator Products, Inc., 2005 Walden Avenue, Buffalo, New York, as is a companion solid state closed loop controller sold under the designation model 5000 and illustrated at 101 in FIG. 1.

Controller 101 has control and feedback lines in electrical cable 103 for controlling the actuator 91 and thus changing the end elevation of the dual deck separating device 11. Controller 101 may be of the type capable of simultaneously controlling a plurality of similar actuators on similar separating devices by way of control and feedback signals in cables 105 and 107 with the number of separating devices limited only by the particular controller design.

Throughout the discussion several terms such a "corner" have been used to describe a location, for example, of the coupling between the head motion device and the deck 13. Such terms are necessarily somewhat general since, again for example, the head motion device 39 is not coupled exactly at the corner of the parallelogram. In any event this parallelogram configuration may be thought of a having major and minor diagonals with the minor diagonal extending essentially between the actuator lifted corner 47 and the head motion device coupling point near corner 45 in FIG. 3. The direction of reciprocatory motion imparted to the table is essentially along this minor diagonal or axis and side elevation adjustments by controlling turnbuckle 75 essentially tilt the table about this axis. On the other hand, end elevation adjustments raise and lower corners 47 and 69 in unison as opposed to movements in an opposite sense when, for example, corner 17 is raised by tightening turnbuckle 75 and corner 69, with its constant force bias lowers.

From the foregoing it is now apparent that a novel concentrator of the type having a separating table and drive unit and having a plurality of wire ropes supporting the table and drive unit which may be end elevation adjusted by selectively raising and lowering one of those wire ropes under the control of an operator located remote from the concentrator has been disclosed meeting the objects and advantageous features set out here and before as well as others and that modifications as to the precise configuration, shapes and details may be made by those having ordinary skill in the art without departing from the spirit of the invention or the scope thereof as set out by the claims which follow.

What is claimed is:

1. In a pendantly supported material separating device of the type having a polygonal deck to which a material mixture is supplied, a head motion device for imparting a reciprocatory motion to the deck to induce migration of mixture portions along the deck, and means along respective deck edges for receiving from the deck respective material fractions segragated in accordance with the respective fraction specific gravities; a deck attitude adjustment arrangement for changing the inclination of the deck to thereby modify the respective fraction constituents, comprising means for supporting a first deck corner, means for supporting a second deck corner at any selected elevation, said second corner means including remotely actuable means for varying the elevation of the second deck corner which thereby induces correlative changes in elevation of the first deck corner thereby adjusting the attitude of the deck, second deck corner support means comprising a fixed location pulley, a wire rope passing over the pulley and having one lever end fastened to the second deck corner, a lever having a fulcrum fixed relative to the pulley and with one lever end fastened to the wire rope other end, the remotely actuable means comprising an electro-mechanical actuator coupled to the other lever end so that energization of the actuator from a remote location induces pivotal movement of the lever and motion of the wire rope over the pulley raising and lowering the second deck corner.

2. The adjustment arrangement of claim 1 wherein the first deck corner support means comprises a fixed location pulley, a wire rope passing over the pulley and having one end fastened to the first corner, and a counterbalance weight fastened to the opposite end of the wire rope and suspended thereby from the pulley to provide a relatively constant lifting force on the first corner.

3. The adjustment arrangement of claim 2 wherein the reciprocatory motion imparted to the deck is generally along a line extending between the head motion device near one corner the second corner diagonally opposite the one corner.

4. The adjustment arrangement of claim 3 further comprising an additional wire rope having a fixed upper end and a lower end fastened to a third corner diagonally opposite said first corner, the additional wire rope including manually adjustable means for selectively lengthening and shortening the effective length of the wire rope thereby selectively lowering and raising the third corner.

5. The adjustment arrangement of claim 4 wherein the first and second corners move in a like sense during attitude adjustment while the first and third table corners move in opposite senses during manual adjustment.

6. In a material separating system having a plurality of pendantly supported decks with head motion devices for imparting a reciprocatory motion to each deck to separate material mixtures supplied to the decks into at least two fractions, a first fraction having a specific gravity above a predetermined value and a second fraction having a specific gravity below the predetermined value, the improvement comprising a plurality of remotely actuable means each for modifying the attitude of a respective deck and therefore also the predetermined specific gravity value by changing the pendant support thereof, and a common control unit for simultaneously actuating the plurality of remotely actuable means to change in unison the separating gravities of respective decks.

7. A concentrator comprising a separating deck and a drive unit coupled to the deck for imparting a differential reciprocating motion to the deck with a plurality of wire ropes pendantly supporting the deck and drive unit, one of the wire ropes exerting a constant upward bias on the deck independent of deck altitude and another of the wire ropes adapted to be selectively raised and lowered under the control of an operator located remote from the concentrator, said separating deck being shaped generally as a parallelogram, the drive unit coupled to one corner of the deck and said other wire rope supporting a second table corner diagonally opposite said one corner, a pulley fixed at a location above the second corner, said other wire rope passing over the pulley and having one end fastened to the second corner, a lever having a fulcrum fixed relative to the pulley and with one lever end fastened to said another with rope other end, an electro-mechanical actuator coupled to the other lever end to be electively energized by an operator at a remote location to induce pivotal movement of the lever and motion of the wire rope over the pulley raising and lowering the second corner.

8. The system of claim 6 wherein each remotely actuable means includes a fixed location pulley, a wire rope passing over the pulley and having one end fastened to the second deck corner, a lever having a fulcrum fixed relative to the pulley and with one lever end fastened to the wire rope other end, the remotely actuable means comprising an electro-mechanical actuator coupled to the other lever end and to said common control unit so that energization of the actuator from a remote location induces pivotal movement of the lever and motion of the wire rope over the pulley raising and lowering the second deck corner.

* * * * *